US011454127B2

(12) United States Patent
Yam et al.

(10) Patent No.: US 11,454,127 B2
(45) Date of Patent: Sep. 27, 2022

(54) VANE FOR GAS TURBINE ENGINE

(71) Applicant: PRATT & WHITNEY CANADA CORP., Longueuil (CA)

(72) Inventors: Tammy Yam, Richmond Hill (CA); Tibor Urac, Mississauga (CA); Paul Aitchison, Hamilton (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 88 days.

(21) Appl. No.: 16/692,178

(22) Filed: Nov. 22, 2019

(65) Prior Publication Data

US 2021/0156272 A1 May 27, 2021

(51) Int. Cl.
*F01D 9/04* (2006.01)
*F01D 11/00* (2006.01)

(52) U.S. Cl.
CPC ..... *F01D 9/042* (2013.01); *F01D 11/003* (2013.01); *F05D 2230/60* (2013.01); *F05D 2240/11* (2013.01); *F05D 2240/90* (2013.01)

(58) Field of Classification Search
CPC ..... F05D 2240/90; F05D 2240/11; F05D 2230/60; F01D 11/003; F01D 9/042; F01D 11/005
See application file for complete search history.

(56) References Cited

U.S. PATENT DOCUMENTS 5,332,360 A * 7/1994 Correia ..... F01D 9/042 29/889.21
5,630,700 A * 5/1997 Olsen ..... F01D 9/042 415/134
6,464,456 B2 10/2002 Darolia et al.
7,452,189 B2 * 11/2008 Shi ..... F01D 5/282 416/226
7,637,718 B2 12/2009 Barnett et al.
(Continued)

FOREIGN PATENT DOCUMENTS

EP 2966264 A1 1/2016
WO 2007030925 A1 3/2007

OTHER PUBLICATIONS

George Kunkel, Cost Effective Grooves for the Spira Shield Family of Groove Mounted Gaskets, Jun. 15, 2006, pp. 1-5, Spira Manufacturing Corporation, United States of America.
(Continued)

*Primary Examiner* — Justin D Seabe
*Assistant Examiner* — Andrew Thanh Bui
(74) *Attorney, Agent, or Firm* — Norton Rose Fulbright Canada LLP

(57) ABSTRACT

A vane configured to be disposed in a gas path defined in part by an inner surface of a case of a gas turbine engine is provided. The vane comprises a vane body configured to extend through an aperture in the case and a vane head disposed at an end of the vane body. The vane head has an abutting surface configured to contact an outer surface of the case when the vane body extends through the aperture, and a groove configured to receive a sealing member. The groove opens to the abutting surface and is outwardly open relative to an inner region surrounded by the groove. The groove has an inner seating surface that hinders movement of the sealing member toward the abutting surface and can facilitate installation of the vane in the engine.

17 Claims, 8 Drawing Sheets

(56) References Cited

U.S. PATENT DOCUMENTS

| | | | | |
|---|---|---|---|---|
| 9,726,028 | B2 * | 8/2017 | Marra | B22D 19/0072 |
| 9,951,639 | B2 | 4/2018 | Ivakitch et al. | |
| 10,337,340 | B2 | 7/2019 | Cortequisse | |
| 2013/0205800 | A1 | 8/2013 | Ivakitch et al. | |
| 2018/0016924 | A1 * | 1/2018 | Gallier | F01D 25/246 |
| 2018/0171809 | A1 | 6/2018 | Urac et al. | |
| 2018/0172026 | A1 | 6/2018 | Urac et al. | |

OTHER PUBLICATIONS

European Patent Office, Communication re extended European search report for European patent application No. 20209349.8, dated Feb. 18, 2021.

English translation of Europe patent document No. EP2966264 dated Jan. 13, 2016, https://patents.google.com/patent/EP2966264A1/en?oq=EP2966264A1, accessed on Mar. 15, 2021.

* cited by examiner

VANE FOR GAS TURBINE ENGINE

TECHNICAL FIELD

The disclosure relates generally to gas turbine engines, and more particularly to stator vanes installed therein.

BACKGROUND

Gas turbine engine rotors typically have a row of stator vanes upstream or downstream thereof. Vanes may be provided in segments, but may also be provided as individually insertable vanes. The vanes are usually individually manufactured from a molding and/or machining process and are radially inserted inside the engine case through the annular gas flow passage. To minimize leakage between the vane and the case, a grommet may be disposed between the external surface of the case and the vane head. However, the grommet may be subjected to air leaks which may affect the engine's performance.

SUMMARY

In one aspect, the disclosure describes a vane configured to be disposed in a gas path defined in part by an inner surface of a case of a gas turbine engine. The vane comprises:

a vane body configured to extend through an aperture in the case; and a vane head disposed at an end of the vane body and configured to be disposed outside the gas path when the vane body extends through the aperture, the vane head having:

an abutting surface configured to contact an outer surface of the case when the vane body extends through the aperture; and a groove configured to receive a sealing member, the groove surrounding an inner region including the aperture when the vane body extends through the aperture, the groove opening to the abutting surface and being outwardly open relative to the inner region, the groove having an inner seating surface configured to receive the sealing member and hinder movement of the sealing member toward the abutting surface.

In another aspect, the disclosure describes an assembly for a gas turbine engine. The assembly comprises:

a case having an inner side defining a portion of a gas path of the gas turbine engine and an outer side opposite the inner side, the case having an aperture extending from the inner side to the outer side;

a sealing member; and a vane secured with the case, the vane including:

a vane body extending in the gas path and through the aperture; and a vane head disposed at an end of the vane body and outside of the gas path, the vane head including:

an abutting surface contacting a surface of the outer side of the case; and a groove receiving the sealing member while the sealing member provides a seal between the vane head and the surface of the outer side of the case, the groove surrounding an inner region including the aperture, the groove being open to the abutting surface and also being outwardly open relative to the inner region, the groove having an inner seating surface receiving the sealing member and hindering movement of the sealing member toward the abutting surface.

In a further aspect, the disclosure describes a method of installing a vane in a gas turbine engine. The vane has a vane body for extending in a gas path of the gas turbine engine and a vane head attached to the vane body. The method comprises:

installing an o-ring sealing member in a groove formed on the vane head, the groove open to an abutting surface of the vane head configured to contact an outer surface of a case of the gas turbine engine when the vane body extends through an aperture of the case, a seating surface of the groove configured to receive the o-ring member and hinder movement of the o-ring sealing member toward the abutting surface, the groove being outwardly open relative to an inner region surrounded by the groove;

receiving the vane body through a vane-receiving aperture of the case; and compressing the o-ring sealing member between the vane head and the case to form a seal between the vane head and the case.

Further details of these and other aspects of the subject matter of this application will be apparent from the detailed description included below and the drawings.

DESCRIPTION OF THE DRAWINGS

Reference is now made to the accompanying drawings, in which:

FIG. 4B is an enlarged perspective view of part of the vane shown in

FIG. 4A;

FIG. 6 is a flowchart illustrating an exemplary method of installing a vane in a gas turbine engine.

DETAILED DESCRIPTION

The following disclosure relates to stator vanes for gas turbine engines, and associated installation methods. A vane as disclosed herein includes a vane body configured to extend in a gas path of the gas turbine engine and a vane head disposed at an axial end of the vane body. The vane head is configured to be sealed with a case defining par of the gas path. The seal between the vane head and the case may be achieved using a compressible sealing member that can be retained on the sealing head. Retaining the sealing member on the sealing head may facilitate installation of the vane in the engine by preventing the sealing member from becoming displaced from the vane head during handling and positioning of the vane in the engine.

In some embodiments, the design of the vane head disclosed herein may accommodate a standard (e.g., off the shelf) sealing member such as an o-ring to be used instead of a more expensive custom-molded grommet.

Aspects of various embodiments are described in relation to the figures. The term "substantially" as used herein may be applied to modify any quantitative representation which could permissibly vary without resulting in a change in the basic function to which it is related.

Figure 1:
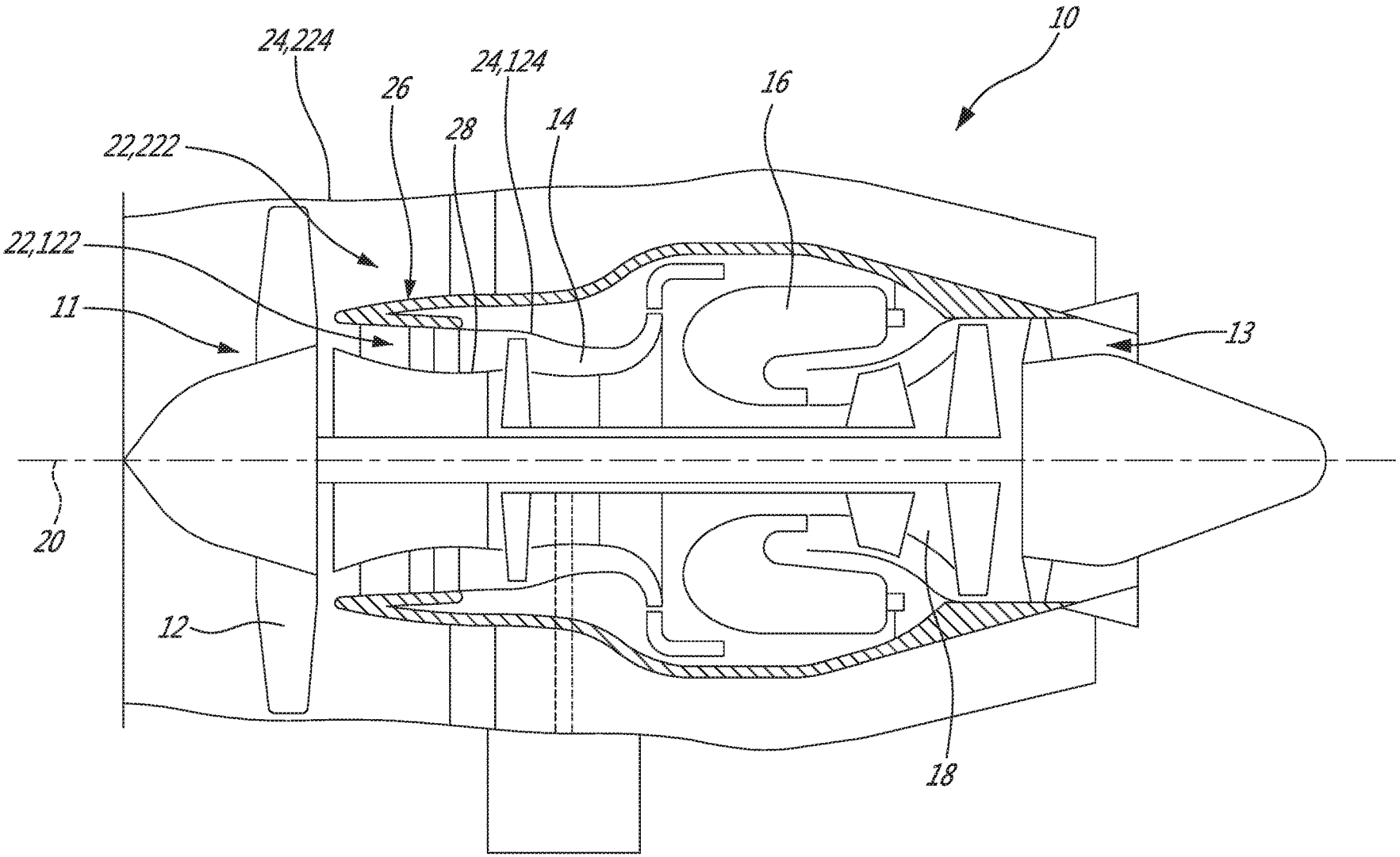
FIG. 1 schematically shows an axial cross-section view of a turbo-fan gas turbine engine.

FIG. 1 illustrates a gas turbine engine 10 of a type preferably provided for use in subsonic flight, generally comprising in serial flow communication, a multistage compressor 14 for pressurizing air received through an inlet 11 of the gas turbine engine 10, a combustor 16 in which the compressed air is mixed with fuel and ignited for generating an annular stream of hot combustion gases, and a turbine section 18 for extracting energy from the combustion gases. Engine 10 may include a conventional or other type of gas turbine engine suitable for use in aircraft applications. For example, engine 10 may include a turbofan or a turboprop type of engine. In the case of a turbofan engine, ambient air is propelled through a fan 12 upstream of the multistage compressor 14.

The flow of air/gas through the gas turbine engine 10 between the inlet 11 and an outlet 13 of the gas turbine engine 10 defines a gas path 22. An outer circumference of the gas path 22 is defined by a case 24 of the gas turbine engine 10. The case 24 may include one or a plurality of separate components. The separated components may be assembled to form an internal surface for substantially directing the flow of gas through the gas turbine engine 10 and thereby forming the gas path 22 which may be substantially annular. For example, the case 24 may include a plurality of cylindrical components of varying diameters and means for inter-connecting the plurality of cylindrical components.

In some embodiments, the gas path 22 may be a bypass flow path 222 (bypass duct) lying between an outer surface of an engine core 26 and an inner surface of an outer case 224 of the gas turbine engine 10. The outer case 224 may be surrounded by additional components (e.g., nacelle) of the gas turbine engine 10. The engine core 26 includes the multistage compressor 14, combustor 16, and turbine section 18. In some embodiments, the gas path 22 maybe be a substantially annular gas path 122 (hereafter referred to as gas path 122) passing through the engine core 26, i.e. a flow path through the multistage compressor 14, combustor 16, and the turbine section 18, and lying between a case 124 of the engine core 26 and radially-inner surface of the engine core 26.

The gas turbine engine 10 may include a plurality of rotors rotating about a central axis 20 of the gas turbine engine 10, e.g. fan 12, impellers of the multistage compressor 14, or turbine rotors of the turbine section 18. The gas turbine engine 10 may further include one or more stators. In some embodiments, stators may be present upstream of an impeller or other bladed rotor of the multistage compressor 14 in the gas path 122. In some embodiments, stators may be present downstream of the fan 12 in the bypass flow path 222 (fan exit stators). A stator may comprise one or more vanes as described herein circumferentially distributed around the central axis 20 and disposed in the gas path 22.

Figure 2A:
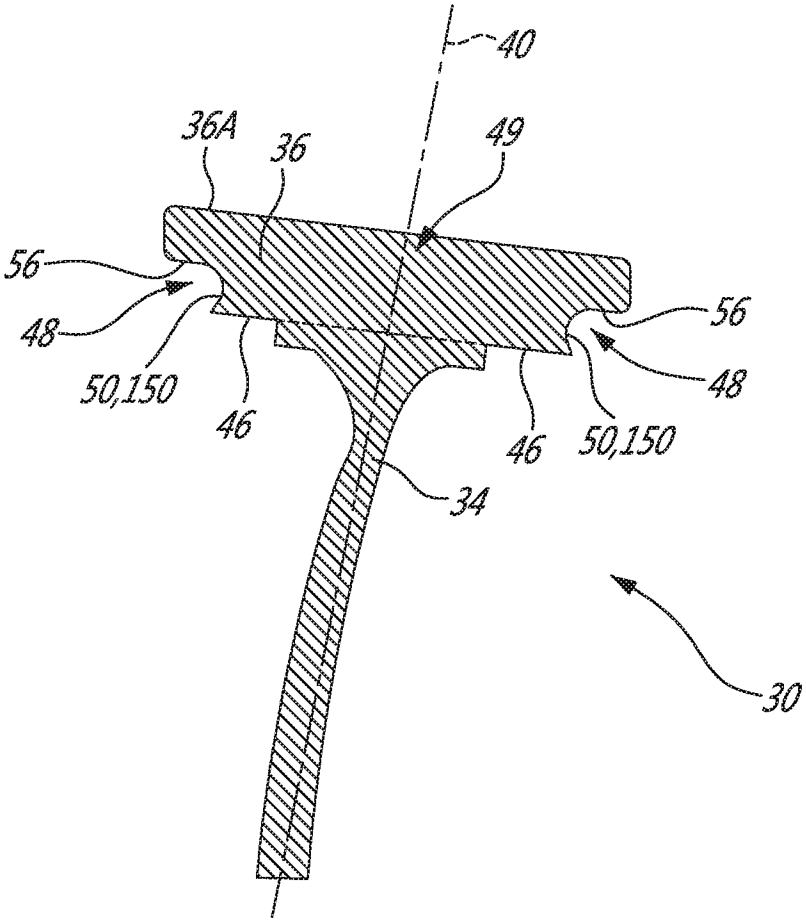
FIG. 2A shows a longitudinal cross-section of part of a vane of the engine of FIG. 1.
Figure 2B:
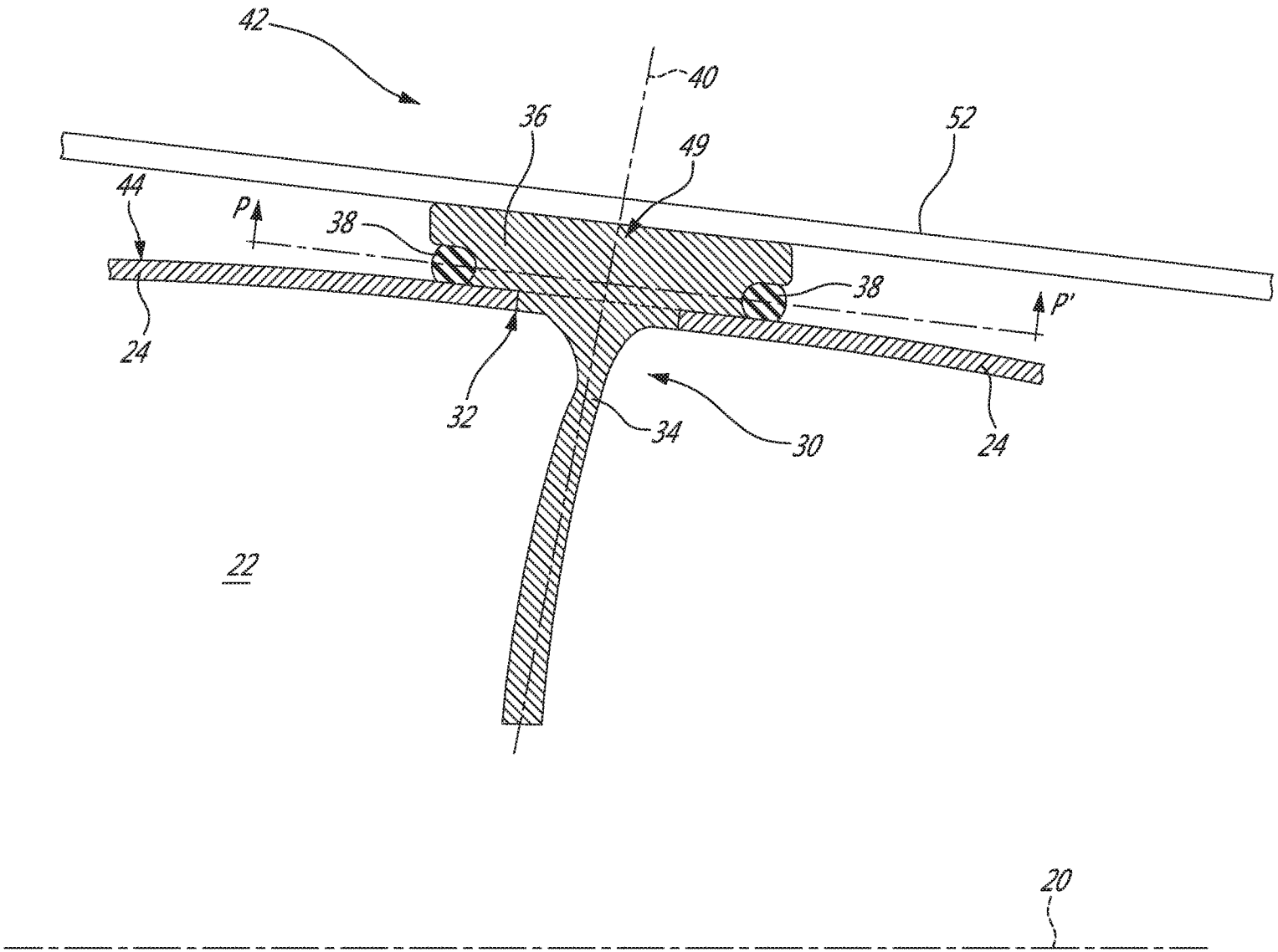
FIG. 2B shows a longitudinal cross-section of the vane of FIG. 2A installed in the engine of FIG. 1.

FIG. 2A is a cross-section of a vane 30. FIG. 2B is a cross-section of the vane 30 of FIG. 2A installed in a gas turbine engine 10. In reference to both FIGS. 2A and 2B, the vane 30 is at least partially disposed in a gas path 22. The vane 30 passes through a vane-receiving aperture 32 formed in a case 24 of the gas turbine engine 10. The vane 30 may extend from the case 24 towards the central axis 20. In some embodiments, the vane 30 is a fan exit vane disposed in the bypass flow path 222. In other embodiments, the vane 30 is a compressor vane disposed in a portion of the gas path 122 within the multistage compressor 14.

The vane 30 includes a vane body 34 at least partially disposed in the gas path 22. In some embodiments, the vane body 34 is substantially completely disposed in the gas path 22. Depending on its configuration, the vane body 34 may, in some embodiments, be substantially aligned with an aperture axis 40 of the vane-receiving aperture 32. In some embodiments, the aperture axis 40 may extend between two ends of the vane body 34. The aperture axis 40 may be substantially parallel to an airfoil stacking line of the vane 30 in some embodiments. In some embodiments, the aperture axis 40 may be substantially aligned with a radial direction of the gas turbine engine 10. For example, the aperture axis 40 may be substantially perpendicular to the central axis 20. In some embodiments, when the vane 30 is installed in the gas turbine engine 10, the aperture axis 40 may extend between a point of the vane body 34 closest to the central axis 20 of the gas turbine engine 10 and another point closest to the case 24.

The vane 30 includes a vane head 36 disposed at one end of the vane 30, wherein the end is with respect to the aperture axis 40. The vane head 36 is disposed outside the gas path 22 on outer side 42 opposite the gas path 22. The vane head 36 includes an abutting surface 46 in contact with a portion of a surface 44 of the case 24 when the vane body 34 extends through the vane-receiving aperture 32.

The vane head 36 includes a groove 48 extending completely around the aperture axis 40. The groove 48 defines a circumferential path around the aperture axis 40 at a peripheral end of the vane head 36. A sealing member 38 is retained in the groove 48. The sealing member 38 may be a gasket. The sealing member 38 may be made of an elastomeric or other material suitable for withstanding the applicable operating conditions depending on which region of the engine 10 the vane 30 is installed. The sealing member 38 may be an o-ring. The sealing member 38 may be have a substantially circular overall shape and a circular cross-sectional profile when not deformed. Alternatively, the sealing member 38 may be have a noncircular overall shape and/or a noncircular cross-sectional profile when not deformed.

The sealing member 38 may be retained in the groove 48 prior to installation of the vane 30 in the gas turbine engine 10. The sealing member 38 may be so retained without excessive deformation/stretching of the sealing member 38. Upon installation in the gas turbine engine 10, the sealing member 38 may be compressed. A compression of the sealing member 38 may facilitate creation of a sealing engagement between the case 24 and the vane 30. The sealing may be achieved by way of a compressive force applied to the sealing member 38 between the abutting surface 46 and the surface 44 of the case 24.

A strap 52 extending around an outer circumference of the case 24 may secure the vane 30 in-place by applying a radially-inward force on the vane head 36 thereby compressing the sealing member 38. The strap 52 may apply a radially inward compressive force on the vane head 36 against the case 24, relative to the central axis 20. The strap 52 may apply a compressive force on the vane head 36 (on an outer surface 36A thereof) along a direction parallel to the aperture axis 40.

The vane head 36 may have an outer surface 36A that defines a strap holder for receiving a corresponding fastening strap 52 or other member used to fasten and retain the vane 30 in place with the case 24. In one embodiment, the strap 52 extends circumferentially over the strap holder of all by-pass stator vanes that may be part of a vane ring in order to retain a circular array of vanes 30. The strap holder 32 may include two elongated and axially spaced-apart fingers extending outwardly from the outer surface 36A of the vane head 36. In an alternate embodiment, the strap holder is in the form of a circumferential groove defined in the outer surface 36A. Any other suitable means may be used to maintain the vanes 30 in position, such as, but not limited to clamps, fasteners, passages, channels, and the like. In an embodiment, the outer surface 36A is smooth and without a strap holder, the strap holder relying on friction or on other components on the case 24 to remain in position.

The groove 48 is open to the abutting surface 46 and hence to the surface 44 of the case 24 when installed. The groove 48 is also outwardly open relative to an inner region 49 surrounded by the groove 48 including the (vane-receiving) aperture 32. The groove 48 may be outwardly open relative to the aperture axis 40. The groove 48 defines an inner seating surface 50, wherein the inner seating surface 50 is inner relative to the aperture axis 40 and the inner region 49. The inner seating surface 50 hinders movement of the sealing member 38 in the groove 48, thereby retaining the sealing member 38 in the groove 48. The inner seating surface 50 hinders movement of the sealing member 38 towards the abutting surface 46. The inner seating surface 50 may hinder movement of the sealing member 38 along the aperture axis 40. The inner seating surface 50 may be shaped to obstruct movement of the sealing member 38. In some embodiments, the inner seating surface 50 may be a C-shaped inner seating surface 150 having a C-shaped cross-section in a plane transvers to a path 56 (shown in FIG. 3) of the groove 48. In some embodiments, the inner seating surface 50 may be C-shaped inner seating surface 150 having a C-shaped cross-section in a plane containing the aperture axis 40, e.g. the cross-section shown in FIGS. 2A and 2B. The shape of the inner seating surface 50 may conform to a shape of the sealing member 38 so as to form a complementary fit between the two. In some embodiments, the inner seating surface 50 may have a non-linear cross-sectional profile in a plane transvers to the path 56 (shown in FIG. 3) of the groove 48. In some embodiments, the inner seating surface 50 may have a non-linear cross-sectional profile in the plane containing the aperture axis 40. In some embodiments, the inner seating surface 50 may have a non-linear cross-sectional profile in the plane containing the aperture axis 40. The two-sided open shape of the groove 48 may define an overhanging portion 56. The overhanging portion 56 may overhang the surface 44 when the vane 30 is installed in the gas turbine engine 10.

The groove 48 and the inner seating surface 50 may be shaped to facilitate manufacturability, e.g. by molding. Aspects of this disclosure may facilitate vanes made of fiber-reinforced composite materials (e.g., carbon fiber reinforced polymer composites). For example, the outwardly open configuration of the groove 48 may facilitate a molding process (e.g., opening of a mold) used to manufacturing the vane 30. For example, the configuration of the groove 48 may permit the groove 48 to be formed by the molding process as opposed to be formed by a subsequent machining or other material removal operation(s).

Figure 3:
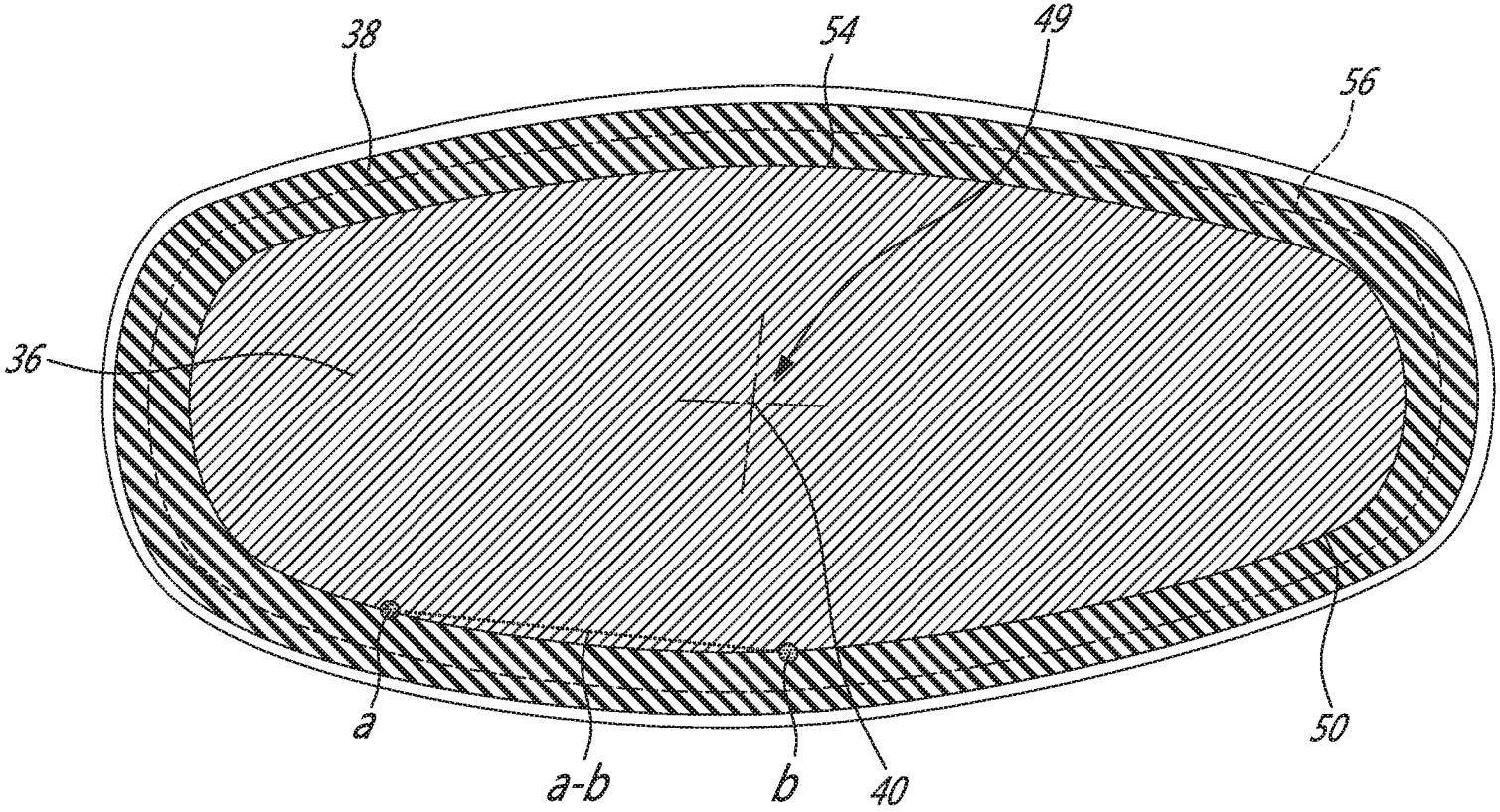
FIG. 3 shows a transverse cross-section of the vane of FIGS. 2A and 2B taken along line P-P' in FIG. 2B.

FIG. 3 is a transverse cross-section of the vane 30. The cross-section is taken along a section P-P' shown in FIGS. 2A and 2B, and the associated cross-sectional plane may be substantially perpendicular to the aperture axis 40. The cross-sectional plane may be substantially perpendicular to a radial direction of the gas turbine engine 10. In this cross-sectional plane, the groove 48 (and inner seating surface 50) may follow a circumferential path 56 around the inner region 49. The groove 48 (and inner seating surface 50) may follow the circumferential path 56 around the aperture axis 40. The groove 48 may be shaped such that the circumferential path 56 is entirely convex, wherein a straight line joining any two points of the circumferential path 56 lies completely within the vane head 36. As an example, two points, a and b, are shown on the seating surface 50 in FIG. 3, along with a line a-b joining a and b. The line a-b lies completely within the vane head 36. In other words, any tangent line on seating surface 50 when viewed in the orientation of FIG. 3 would only intersect the seating surface once. In other words, the circumferential path 56 of the groove 48 around the inner region 49 may be devoid of any concave portions when viewed along the aperture axis 40. The circumferential path 56 of the groove 48 around the aperture axis 40 may be devoid of any concave portions when viewed along a direction along which the inner seating surface 50 is configured to hinder movement. Such a shaped groove 48 may facilitate the use of a standard o-ring as the sealing member 38 and promote uninterrupted contact between the sealing member 38 and the inner seating surface 50 around the aperture axis 40. The circumferential path 56 of the groove 48 may be non-circular when viewed along a direction along which the inner seating surface 50 is configured to hinder movement. The circumferential path 56 of the groove 48 may be non-circular when viewed along the aperture axis 40. It is understood that the sealing member 38 may be slightly stretched outwardly relative to the inner region 49 when retained in the groove 48.

Figure 4B:
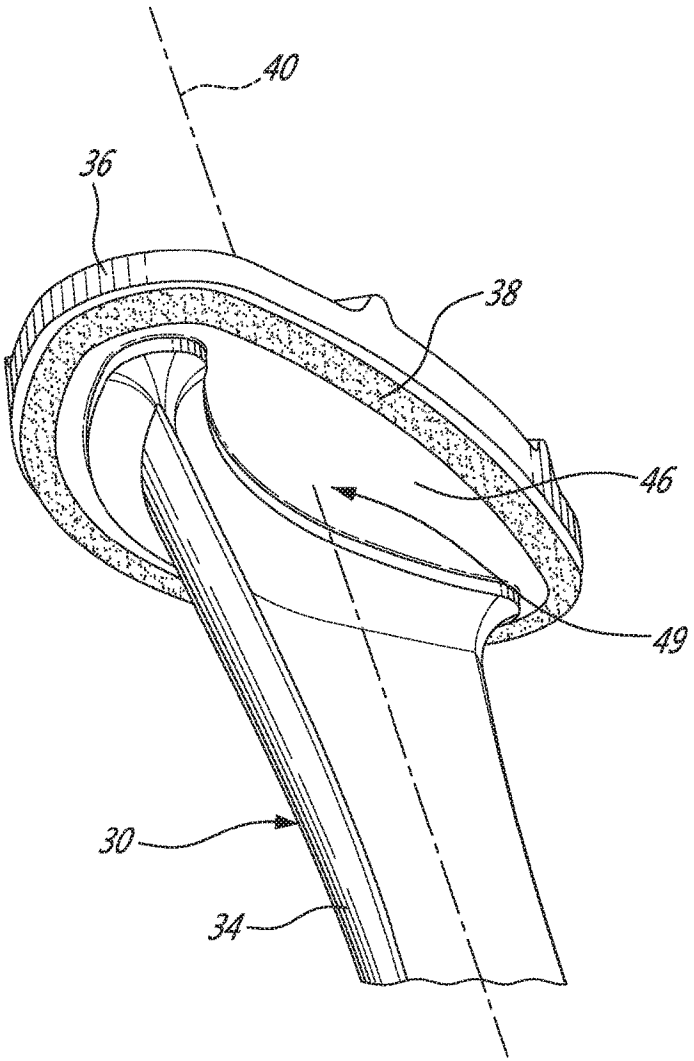
Figure 4A:
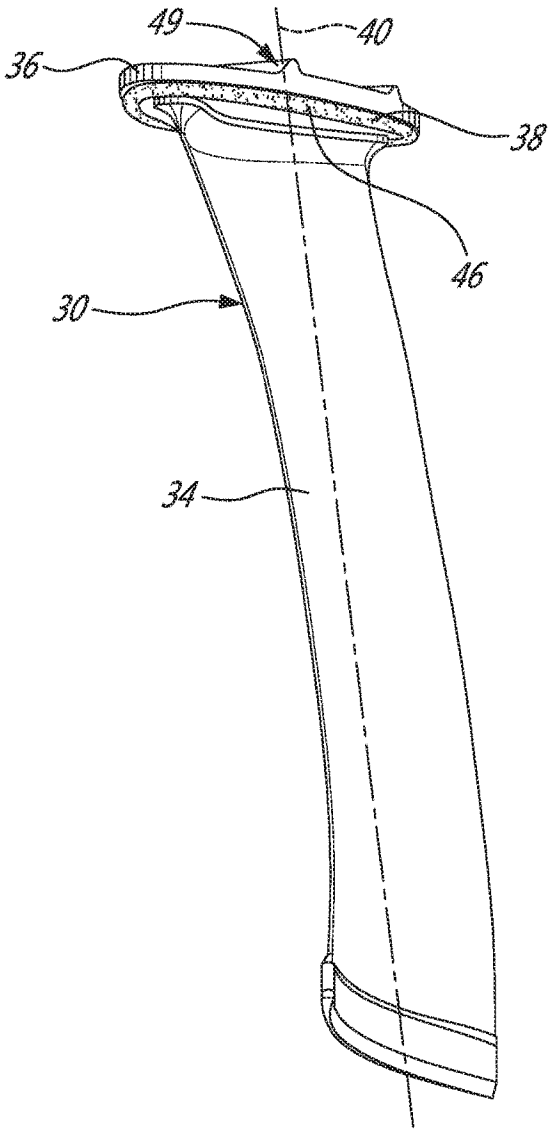
FIG. 4A is a perspective view of the vane of FIGS. 2A and 2B with a sealing member installed thereon.

FIG. 4A is a perspective view of the vane 30 with a sealing member 38 retained therein, according to the embodiment of FIG. 2A. FIG. 4B is an enlarged perspective view of the vane 30 shown in FIG. 4A. The sealing member 38 is retained in the groove 48 by the movement-hindering effect of the inner seating surface 50. Retaining the sealing member 38 in the groove 48 in such a manner, prior to installation in the gas turbine engine 10, may facilitate installation by preventing inadvertent displacement of the sealing member 38 from the vane head 36 during manipulation of the vane 30.

Figure 5A:
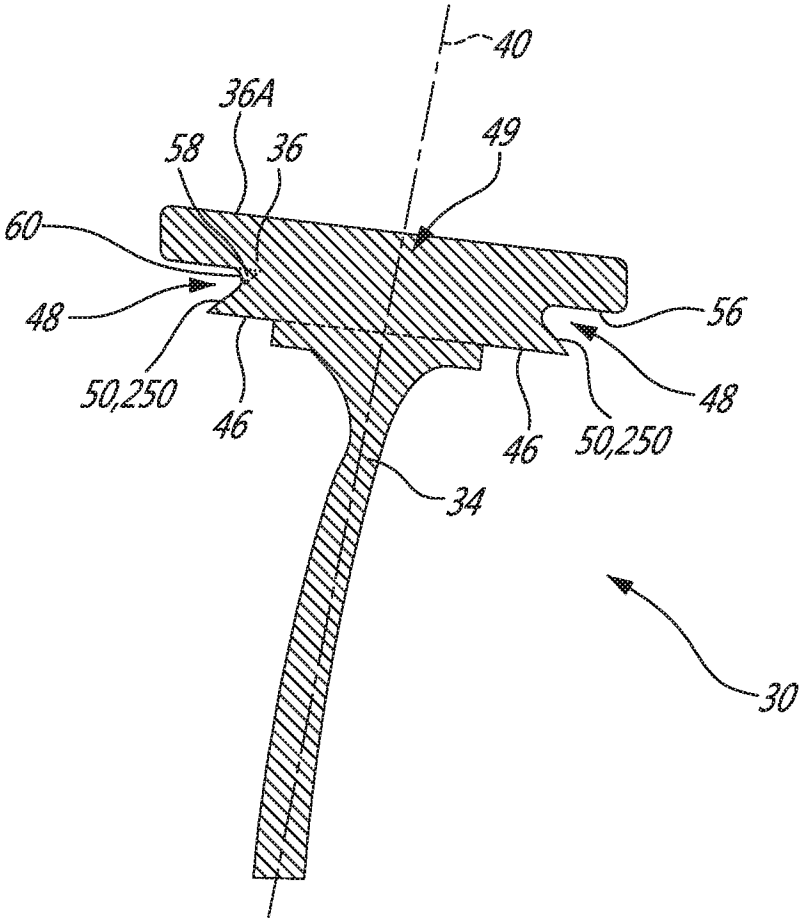
FIG. 5A shows a longitudinal cross-section of part of another vane of the engine of FIG. 1.
Figure 5B:
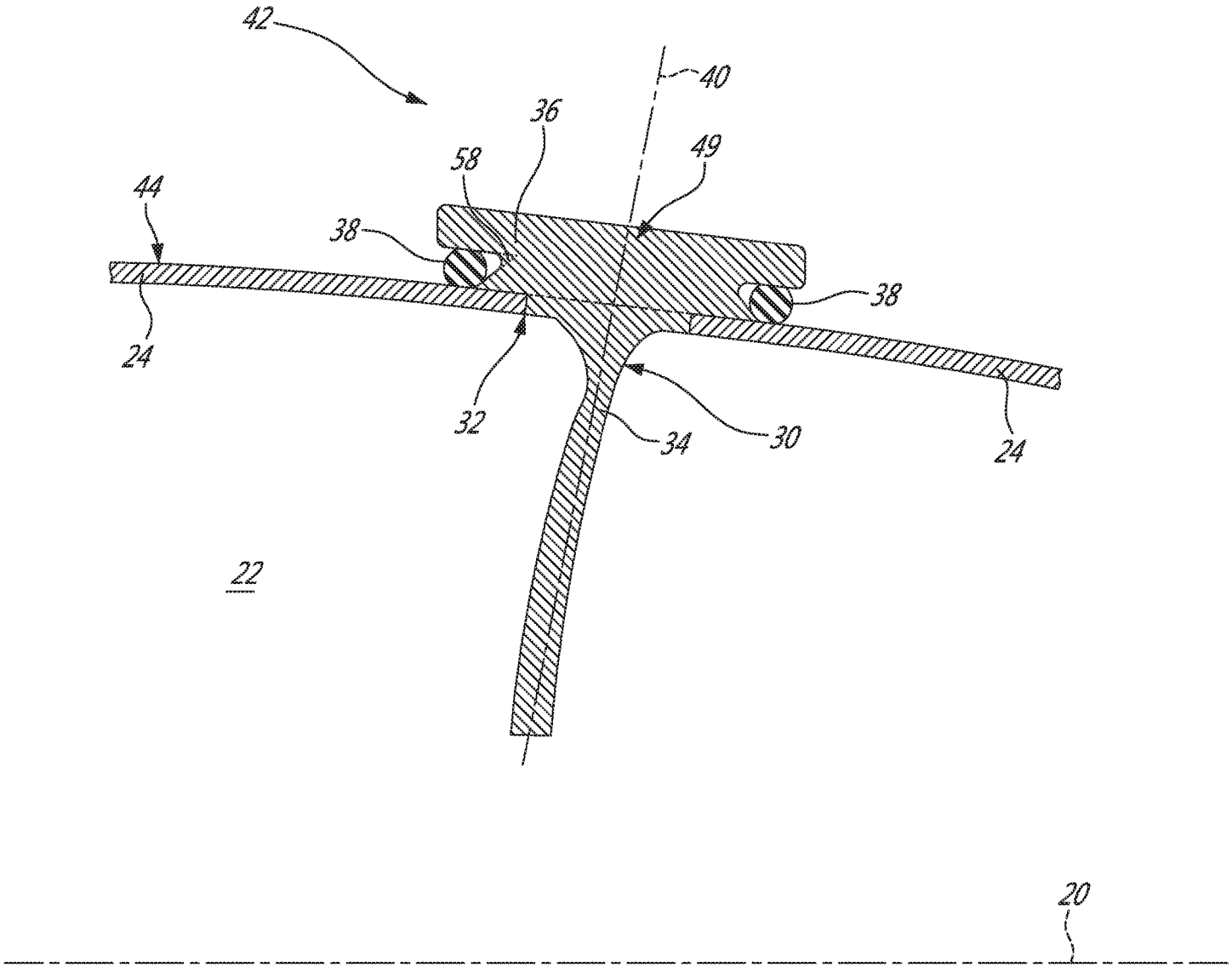
FIG. 5B shows an axial cross-section of the vane of FIG. 5A installed in the engine of FIG. 1.
Figure 8:
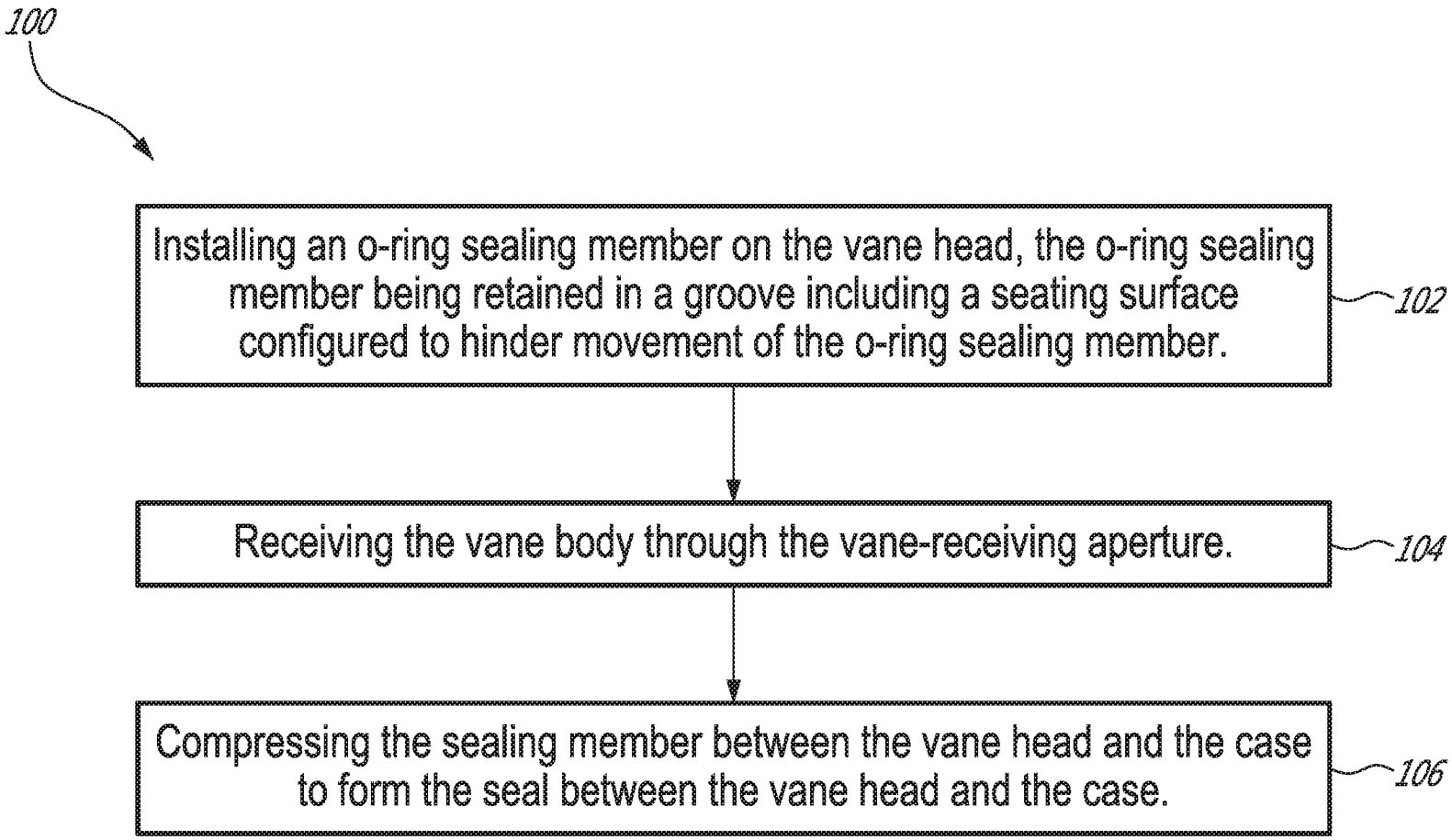

FIG. 5A is a cross-section of a vane 30 according to another embodiment. FIG. 5B is a cross-section of the vane 30 of FIG. 5B installed in a gas turbine engine 10. In reference to both FIGS. 5A and 5B, the groove 48 is defined by inner seating surface 250, overhanging portion 56 and a fillet 60 (rounded intersection) disposed between the inner seating surface 250 and the overhanging portion 56. The inner seating surface 250 and the overhanging portion 56 may define two non-parallel walls forming an acute angle 58. The acute angle formed between the two non-parallel walls may provide retention of sealing member 38 within the groove 48 prior to and during installation of the vane 30 in the gas turbine engine 10. In various embodiments, the acute angle 58 may be less than 85°, less than 80°, less than 70°, less than 60°, less than 50°, less than 40° or less than 30° for example. The fillet 60 may extend along the entirety of the groove 48. The fillet 60 may have a radius that is smaller, larger or substantially the same as a radius of the circular transverse cross-sectional profile of the sealing member 38.

FIG. 6 is a flowchart illustrating an exemplary method 100 of installing a vane 30 in a gas turbine engine. The method 100 may be performed using the vane 30 as described herein. The method 100 comprises:

installing an o-ring sealing member 38 in the groove 48 formed on the vane head 36, the groove 48 open to the abutting surface 46 of the vane head 36 configured to contact the outer surface 44 of the case 24 of the gas turbine engine 10 when the vane body 34 extends through the aperture 32 of the case 24, a seating surface 50 of the groove 48 configured to receive the o-ring sealing member 38 and hinder movement of the o-ring sealing member 38 toward the abutting surface 46, the groove 48 being outwardly open relative to the inner region 49 surrounded by the groove 48 (see block 102);

receiving the vane body 34 through the vane-receiving aperture 32 of the case 24 (see block 104); and compressing the o-ring sealing member 38 between the vane head 36 and the case 24 to form the seal between the vane head 36 and the case 24 (see block 106).

As explained above, the sealing member 38 may be an o-ring. The o-ring may be retained in the groove 48 including the inner seating surface 50 configured to hinder movement of the o-ring towards the abutting surface 46. In some embodiments, the inner seating surface 50 may be configured to hinder movement of the o-ring along the aperture axis 40 of the vane body 34. As shown in FIG. 3, the circumferential path 56 of the groove 48 around the aperture axis 40 may be devoid of any concave portions when viewed along the aperture axis 40. The circumferential path 56 of the groove 48 around the aperture axis 40 may be devoid of any concave portions when viewed along a direction along which the inner seating surface 50 is configured to hinder movement.

The above description is meant to be exemplary only, and one skilled in the relevant arts will recognize that changes may be made to the embodiments described without departing from the scope of the invention disclosed. The present disclosure may be embodied in other specific forms without departing from the subject matter of the claims. The present disclosure is intended to cover and embrace all suitable changes in technology. Modifications which fall within the scope of the present invention will be apparent to those skilled in the art, in light of a review of this disclosure, and such modifications are intended to fall within the appended claims. Also, the scope of the claims should not be limited by the preferred embodiments set forth in the examples, but should be given the broadest interpretation consistent with the description as a whole.

What is claimed is:

1. A vane configured to be disposed in a gas path defined in part by an inner surface of a case of a gas turbine engine, the vane comprising:

a vane body configured to extend through an aperture in the case; and a vane head disposed at an end of the vane body and configured to be disposed outside the gas path when the vane body extends through the aperture, the vane head having:

an abutting surface configured to contact an outer surface of the case when the vane body extends through the aperture; and a groove configured to receive a sealing member, the groove surrounding an inner region including the aperture when the vane body extends through the aperture, the groove opening to the abutting surface and being outwardly open relative to the inner region, the groove having an inner seating surface configured to receive the sealing member and hinder movement of the sealing member toward the abutting surface, the groove being devoid of an outer seating surface disposed outwardly of the inner seating surface and configured to hinder movement of the sealing member toward the abutting surface.

2. The vane of claim 1, wherein the inner seating surface is shaped to obstruct movement of the sealing member toward the abutting surface.

3. The vane of claim 1, wherein the inner seating surface has a C-shaped cross-sectional profile in a plane transverse to a path of the groove.

4. The vane of claim 1, wherein the inner seating surface has a non-linear cross-sectional profile in a plane transverse to a path of the groove.

5. The vane of claim 1, wherein the vane is made of a fiber-reinforced composite material.

6. The vane of claim 1, wherein a path of the groove surrounding the inner region is devoid of any concave portions.

7. An assembly for a gas turbine engine, the assembly comprising:

a case having an inner side defining a portion of a gas path of the gas turbine engine and an outer side opposite the inner side, the case having an aperture extending from the inner side to the outer side;

a sealing member; and a vane secured with the case, the vane including:

a vane body extending in the gas path and through the aperture; and a vane head disposed at an end of the vane body and outside of the gas path, the vane head including:

an abutting surface contacting a surface of the outer side of the case; and a groove receiving the sealing member while the sealing member provides a seal between the vane head and the surface of the outer side of the case, the groove surrounding an inner region including the aperture, the groove being open to the abutting surface and also being outwardly open relative to the inner region, the groove having an inner seating surface receiving the sealing member and hindering movement of the sealing member toward the abutting surface, the groove being devoid of an outer seating surface disposed outwardly of the inner seating surface and configured to hinder movement of the sealing member toward the abutting surface.

8. The assembly of claim 7, wherein the inner seating surface is shaped to obstruct movement of the sealing member toward the abutting surface.

9. The assembly of claim 7, wherein the inner seating surface has a C-shaped cross-sectional profile in a plane transverse to a path of the groove.

10. The assembly of claim 7, wherein the inner seating surface has a non-linear cross-sectional profile in a plane transverse to a path of the groove.

11. The assembly of claim 7, wherein the sealing member is an o-ring.

12. The assembly of claim 7, wherein the vane is made of a fiber-reinforced composite material.

13. The assembly of claim 7, wherein a path of the groove surrounding the inner region is devoid of any concave portions.

14. The assembly of claim 7, wherein the sealing member is compressed between the vane head and the surface of the outer side of the case.

15. A method of installing a vane in a gas turbine engine, the vane having a vane body for extending in a gas path of the gas turbine engine and a vane head attached to the vane body, the method comprising:

installing an o-ring sealing member in a groove formed on the vane head, the groove open to an abutting surface of the vane head configured to contact an outer surface of a case of the gas turbine engine when the vane body extends through an aperture of the case, an inner seating surface of the groove configured to receive the o-ring sealing member and hinder movement of the o-ring sealing member toward the abutting surface, the groove being outwardly open relative to an inner region surrounded by the groove, the groove being devoid of an outer seating surface disposed outwardly of the inner seating surface and configured to hinder movement of the o-ring sealing member toward the abutting surface;

receiving the vane body through a vane-receiving aperture of the case; and compressing the o-ring sealing member between the vane head and the case to form a seal between the vane head and the case.

16. The method of claim 15, wherein the inner seating surface has a C-shaped cross-section in a plane transverse to a path of the groove.

17. The method of claim 15, wherein a path of the groove is devoid of any concave portions.

* * * * *